United States Patent [19]

Sewell et al.

[11] Patent Number: 4,953,328

[45] Date of Patent: Sep. 4, 1990

[54] AIR CONDITIONING COMPRESSOR SECTIONALIZED COVER

[76] Inventors: Scott R. Sewell, 5041 20th Ave. North, St. Petersburg, Fla. 33710; Diane Fleming, 74 Patti Ct., Franklin, Ohio 45005

[21] Appl. No.: 356,174

[22] Filed: May 24, 1989

[51] Int. Cl.[5] ..... E06B 7/092

[52] U.S. Cl. ..... 52/79.1; 52/473

[58] Field of Search ..... 52/5, 79.1, 78, 473; 47/17; 98/42.16

[56] References Cited

U.S. PATENT DOCUMENTS

| | | | |
|---|---|---|---|
| 980,433 | 1/1911 | Phillips | 52/473 |
| 2,046,600 | 7/1936 | Atkinson | 47/17 |
| 2,046,601 | 7/1936 | Atkinson | 47/17 |
| 2,857,634 | 10/1958 | Garbade et al. | 47/17 |
| 3,548,904 | 12/1970 | Mackell . | |
| 3,562,972 | 2/1971 | D'Amato | 52/79.1 |
| 3,618,275 | 11/1971 | Ance . | |
| 3,857,210 | 12/1974 | Austin . | |
| 4,316,405 | 2/1982 | Esposito | 47/17 |
| 4,364,205 | 12/1982 | Scott . | |
| 4,503,646 | 3/1985 | Lowe . | |
| 4,601,139 | 7/1986 | Esposito | 47/17 |
| 4,615,181 | 10/1986 | Greenwood . | |

*Primary Examiner*—Michael Safavi

*Attorney, Agent, or Firm*—Jerry T. Kearns

[57] ABSTRACT

A cover for preventing water and other damage to an external air conditioner compressor/condenser unit is formed as a rectangular housing having vertical sidewalls and a top ceiling portion. An open bottom end of the housing is dimensioned for insertion over an air conditioner compressor unit. The housing has three sidewalls and an open side for abutment against an exterior wall of a house or mobile home. A plurality of rows of pivotal shutters cover each of the sidewalls and top ceiling of the housing and are selectively moveable between open and closed positions. When the air conditioner is not in use, the shutters are closed to protect the unit from the environment. When the air conditioner compressor unit is in use, the shutters are moved to an open position to allow air flow to the unit, while still providing shade to enhance the operating efficiency of the system. The shutters are formed by aligned interlocking sections to allow the housing to be assembled in a variety of different dimensions for use with a variety of different sizes of air conditioner compressor units.

5 Claims, 5 Drawing Sheets

AIR CONDITIONING COMPRESSOR SECTIONALIZED COVER

BACKGROUND OF THE INVENTION

1. Field of the Invention

The present invention relates to air conditioner compressor sectionalized covers, and more particularly pertains to a sectionalized cover for protecting an externally mounted air conditioner compressor/condenser unit from the environment. A typical freon based air conditioning or heat pump system includes an externally mounted compressor/condenser unit provided with a sheet metal housing. These units are exposed to rain and snow, as well as extreme sunshine. The efficiency of these units is degraded when they are heated by the sun. Additionally, these units are subject to damage of the condenser coils by individuals utilizing lawn mowers and other power grass trimming tools adjacent the unit. Finally, these units are typically painted in a green or beige color which is not aesthetically appealing to some individuals. In order to overcome these problems, the present invention provides a sectionalized cover having sidewall and ceiling portions formed by selectively openable shutters to protect such air conditioner units from the environment while allowing air flow when the units are in use.

2. Description of the Prior Art

Various types of sectionalized covers are known in the prior art. A typical example of such a sectionalized cover is to be found in U.S. Pat. No. 3,548,904, which issued to B. Mackell on Dec. 22, 1970. This patent discloses an inflatable cargo housing having a sectionalized construction to protect cargo from the elements. U.S. Pat. No. 3,618,275 which issued to L. Ance on Nov. 9, 1971 discloses a collapsible housing for electrical equipment which is formed by a plurality of interconnected sections. U.S. Pat. No. 3,857,210, which issued to H. Austin on Dec. 31, 1974, discloses an interlocking panel construction for protecting a stack of hay bales which is formed from a multiplicity of corrugated panels, each having an inverted-V configuration. U.S. Pat. No. 4,364,205, which issued to W. Scott on Dec. 21, 1982 discloses a portable grain storage bin formed from a cylindrical wire mesh outer wall which is pegged to the ground, and an inner plastic lining material which is closed at the top after filling of the bin. U.S. Pat. No. 4,503,646, which issued to H. Lowe on Mar. 12, 1985 discloses a storage structure for housing grain and other granular products in which the normally encountered lateral pressure exerted on the walls of the structure is minimized by the spaced slatted configuration of the wall.

While the above mentioned patents are directed to sectionalized covers, none of these devices disclose a sectionalized cover having a plurality of selectively openable and closeable shutters formed by interlocking segments which is suitable for protecting an air conditioner compressor/condenser unit from environmental and other damage. Inasmuch as the art is relatively crowded with respect to these various types of sectionalized covers, it can be appreciated that there is a continuing need for and interest in improvements to such air conditioner compressor sectionalized covers, and in this respect, the present invention addresses this need and interest.

SUMMARY OF THE INVENTION

In view of the disadvantages inherent in the known types of air conditioner compressor covers now present in the prior art, the present invention provides an improved air conditioner compressor sectionalized cover. As such, the general purpose of the present invention, which will be described subsequently in greater detail, is to provide a new and improved air conditioner compressor sectionalized cover which has all the advantages of the prior art air conditioner compressor covers and none of the disadvantages.

To attain this, a representative embodiment of the concepts of the present invention is illustrated in the drawings and makes use of a cover for preventing water and other damage to an external air conditioner compressor/condenser unit which is formed as a rectangular housing having vertical sidewalls and a top ceiling portion. An open bottom end of the housing is dimensioned for insertion over an air conditioner compressor unit. The housing has three sidewalls and an open side for abutment against an exterior wall of a house or mobile home. A plurality of rows of pivotal shutters cover each of the sidewalls and top ceiling of the housing and are selectively moveable between open and closed positions. When the air conditioner is not in use, the shutters are closed to protect the unit from the environment. When the air conditioner compressor unit is in use, the shutters are moved to an open position to allow air flow to the unit, while still providing shade to enhance the operating efficiency of the system. The shutters are formed by aligned interlocking sections to allow the housing to be assembled in a variety of different dimensions for use with a variety of different sizes of air conditioner compressor units.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air conditioner compressor sectionalized cover which has all the advantages of the prior art air conditioner compressor covers and none of the disadvantages.

It is another object of the present invention to provide a new and improved air conditioner compressor sectionalized cover which may be easily and efficiently manufactured and marketed.

It is a further object of the present invention to provide a new and improved air conditioner compressor sectionalized cover which is of a durable and reliable construction.

An even further object of the present invention is to provide a new and improved air conditioner compressor sectionalized cover which is susceptible of a low cost of manufacture with regard to both materials and labor, and which accordingly is then susceptible of low prices of sale to the consuming public, thereby making such air conditioner compressor sectionalized covers economically available to the buying public.

Still yet another object of the present invention is to provide a new and improved air conditioner compressor sectionalized cover which provides in the apparatuses and methods of the prior art some of the advantages thereof, while simultaneously overcoming some of the disadvantages normally associated therewith.

Still another object of the present invention is to provide a new and improved air conditioner compressor sectionalized cover for protecting air conditioner compressor/condenser units from environmental damage. Yet another object of the present invention is to provide a new and improved air conditioner compressor sectionalized cover including a plurality of selectively openable shutters for allowing air flow to an air conditioner unit, while shading the unit from the sun's rays.

Even still another object of the present invention is to provide a new and improved air conditioner compressor sectionalized cover which is assembled from a plurality of interlocking sections for adaptation to a variety of different sizes of air conditioner units.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
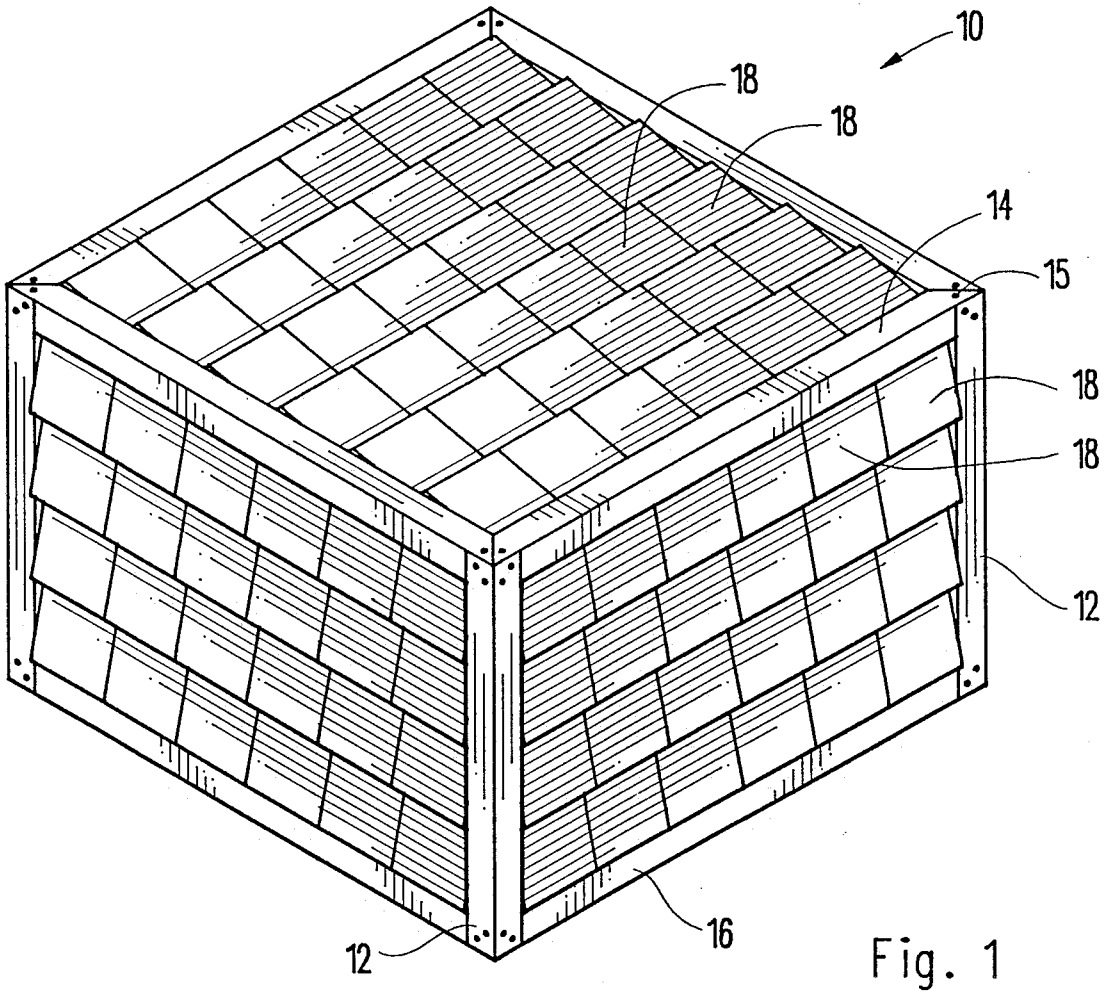
FIG. 1 is a perspective view of the sectionalized cover of the present invention.

With reference now to the drawings, and in particular to FIG. 1 thereof, a new and improved air conditioner compressor sectionalized cover embodying the principles and concepts of the present invention and generally designated by the reference numeral 10 will be described.

More specifically, it will be noted that the first embodiment 10 of the invention includes a generally rectangular housing having three vertical sidewalls and a horizontal top ceiling. The housing has three sidewalls and an open side for abutment against an exterior wall of a house or mobile home. The housing includes four rectangular vertical corner posts 12 disposed at each corner of the housing. Each adjacent pair of the corner posts 12 is connected by a rectangular top rail 14 and a similar bottom rail 16. The rails and posts are secured at each corner by a plurality of conventional threaded fasteners 15. Each of the four vertical sidewalls and the horizontal ceiling of the housing include a plurality of rows of shutters 18. Each row of shutters is formed from a plurality of adjacent interlocking segments 18. In use, the open bottom end of the cover 10 is inserted over an exteriorly mounted air conditioner compressor/condenser unit to protect the unit from the sun and other environmental damage.

Figure 2:
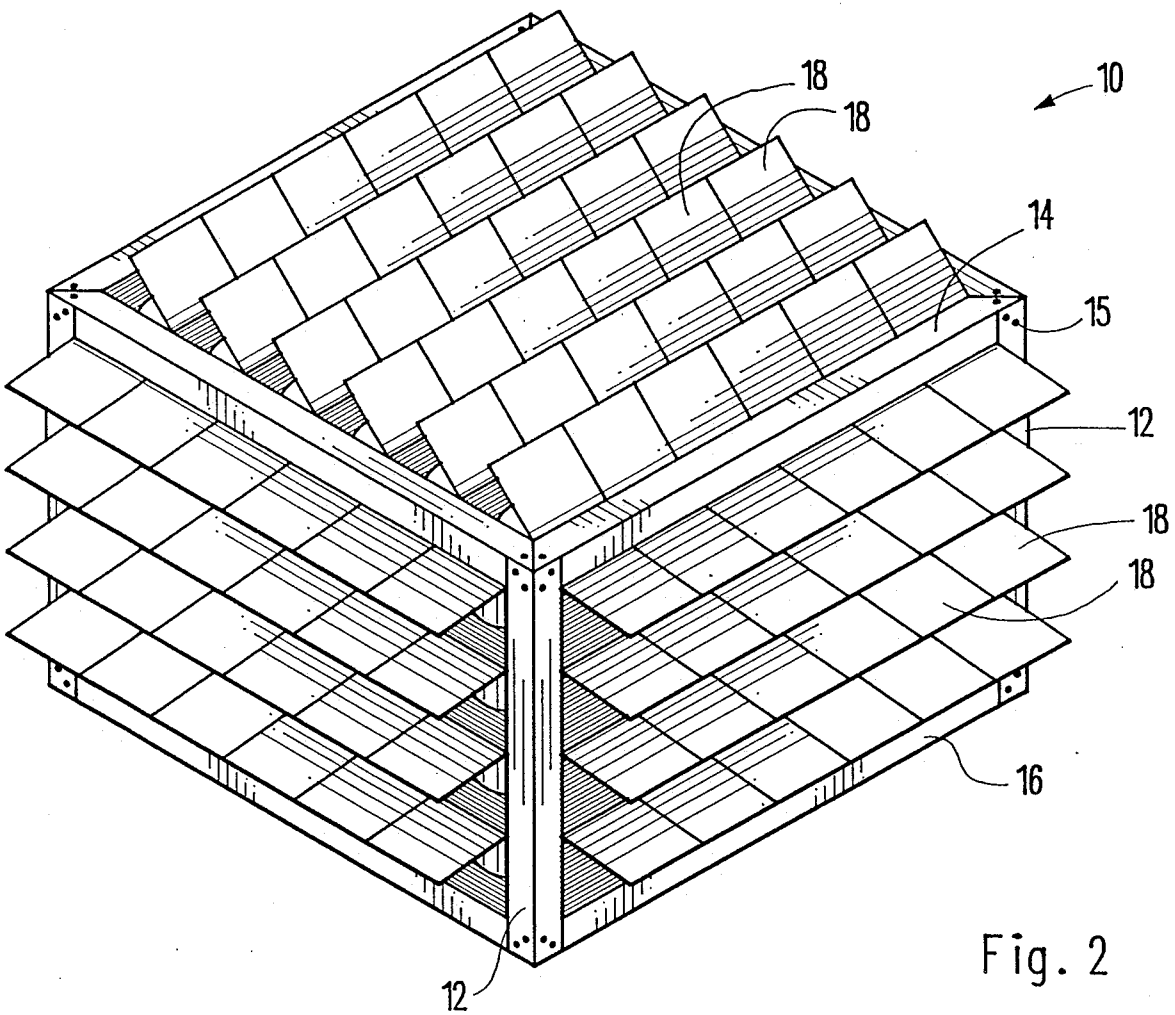
FIG. 2 is a perspective view of the sectionalized cover of FIG. 1 with the shutters in an open position.

As illustrated in FIG. 2, each row of shutters 18 may be pivoted to an open position to allow air flow to the condenser coils of the enclosed unit.

Figure 3:
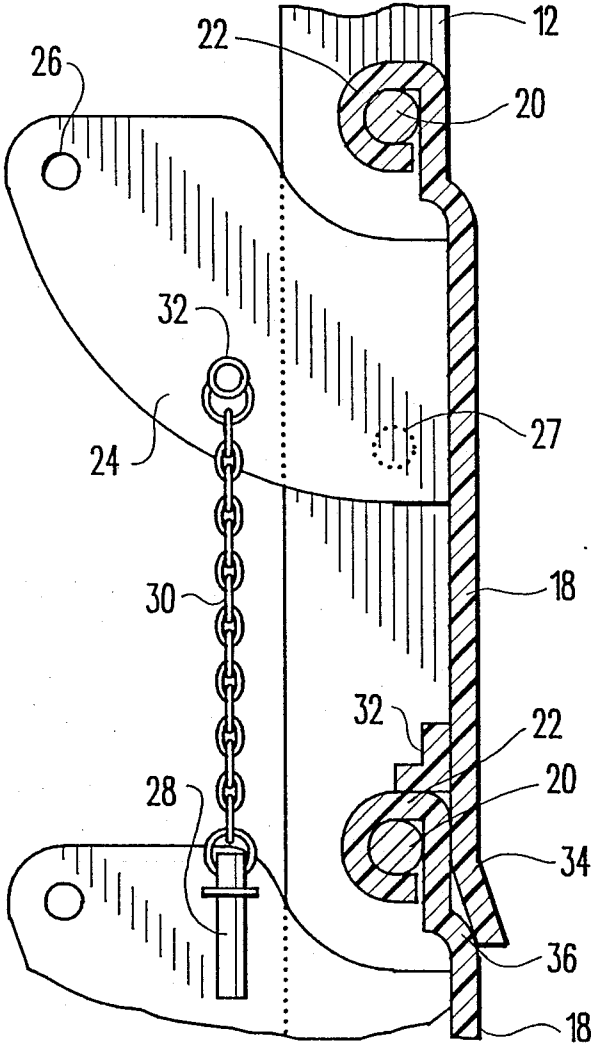
FIG. 3 is a detail view, partially in cross section, illustrating the pivotal shutter mounting.

FIG. 3 illustrates the manner of mounting of the pivotal shutters 18. A plurality of horizontal pivot rods 20 extend in parallel spaced relation between each pair of adjacent corner posts 12 at each of the vertical sidewalls of the housing and also between two of the top rails of the housing ceiling. Each of the shutters 18 has a rolled top edged portion 22 forming a mounting boss receiving one of the pivot rods 20 and mounting the shutter 18 for movement between open and closed positions. The pivot rod 20 may be stationary or mounted for rotation with respect to the post 12. Similarly, the mounting boss 22 may frictionally engage the rod 20 or rotate relative thereto. An arcuate retaining bracket 24 is perpendicularly secured to an inner face of one of the shutters 18 of each row, adjacent one of the corner posts 12 at each of the four housing sidewalls or one of the two top rails 14 at the housing ceiling. Cooperating apertures 26 and 27 are provided in an end portion of the retaining bracket 24 and in the post 12. A retaining pin 28 is secured by a chain 32 to a rivet 32 on the bracket 24. The pin 28 is dimensioned for transverse insertion through the apertures 26 and 27 to retain the shutter 18 in an open position.

An outwardly angled flange 34 is formed at a bottom free edge at each of the shutters 18 and slightly overlaps the next adjacent row of shutters. An inwardly extending rib 32 is provided on an inner face of each of the shutters 18 and is dimensioned for frictional engagement with a top edge of the mounting boss 22, to retain the shutters 18 in a closed position. A radiused outwardly curved portion 36 of the shutters 18 is formed as a location surface for the flange 34 and allows manual grasping of the free edge of the shutter 18 to move the shutter to an open position.

Figure 4:
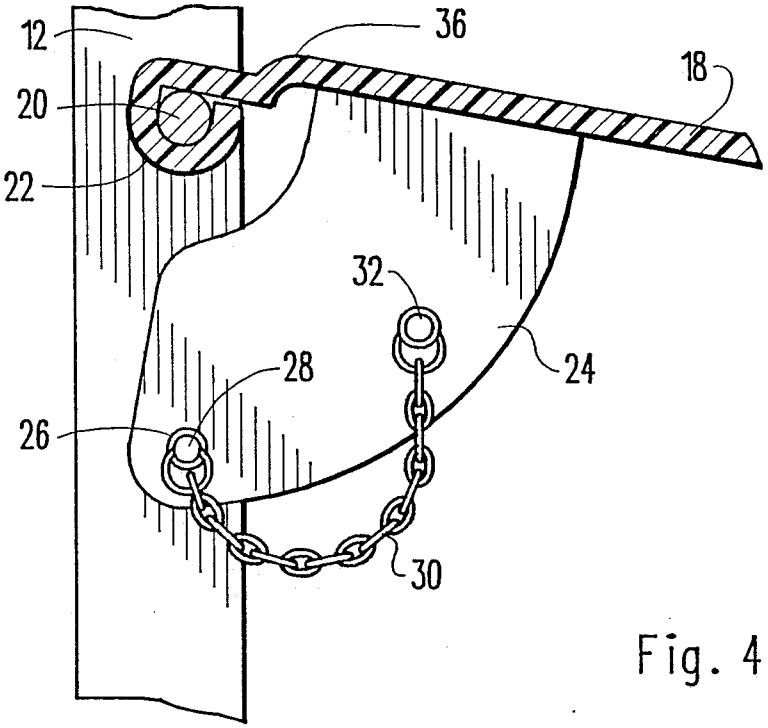
FIG. 4 is a detail view, partially in cross section, illustrating the shutter retaining bracket.

FIG. 4 illustrates the retaining pin 28 in use to secure the shutter 18 in a open position.

Figure 5:
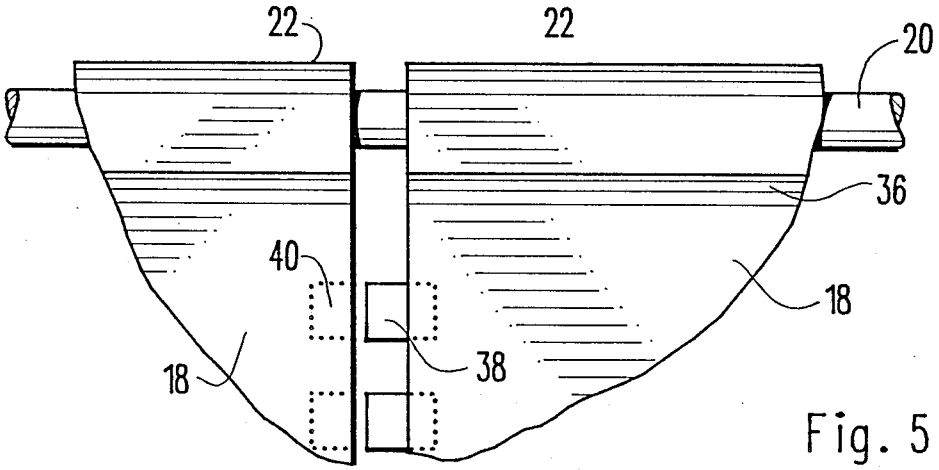
FIG. 5 is an enlarged detail view, partially cut away, illustrating the interlocking construction of the shutters.

FIG. 5 is a detailed view which illustrates the mating interlocking fasteners consisting of a projection 38 formed at one side edge of each of the shutter sections 18 and a cooperating recess 40 provided in an aligned edge of an adjacent shutter section. The shutter sections 18 may be formed in four, six, twelve or eighteen inch lengths and may be assembled from a kit to accommodate a wide variety of different sizes of air conditioner units.

Figure 6:
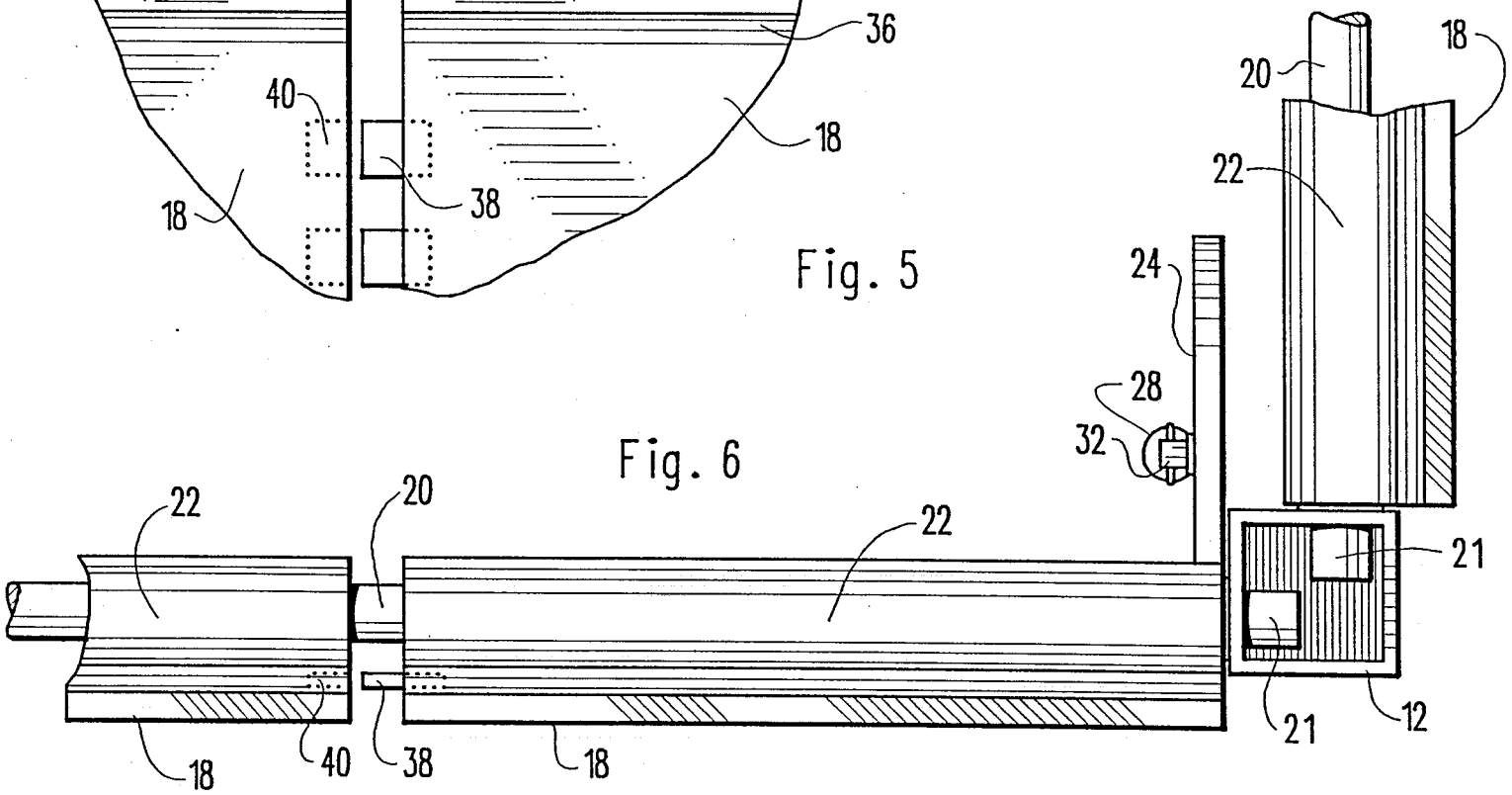
FIG. 6 is a top detail view illustrating the assembly of the shutter units.

FIG. 6 is a top detail view which illustrates end portions 21 of the pivot rods 20 received through apertures provided in the corner post 12. The corner post 12 may be secured by conventional threaded fasteners to the sheet metal housing of the compressor unit. The various components of the cover of the present invention may be formed from sheet metal or from a corrosion free plastic material. The cover may be formed in a variety of different colors to match the exterior of any dwelling unit.

Figure 7:
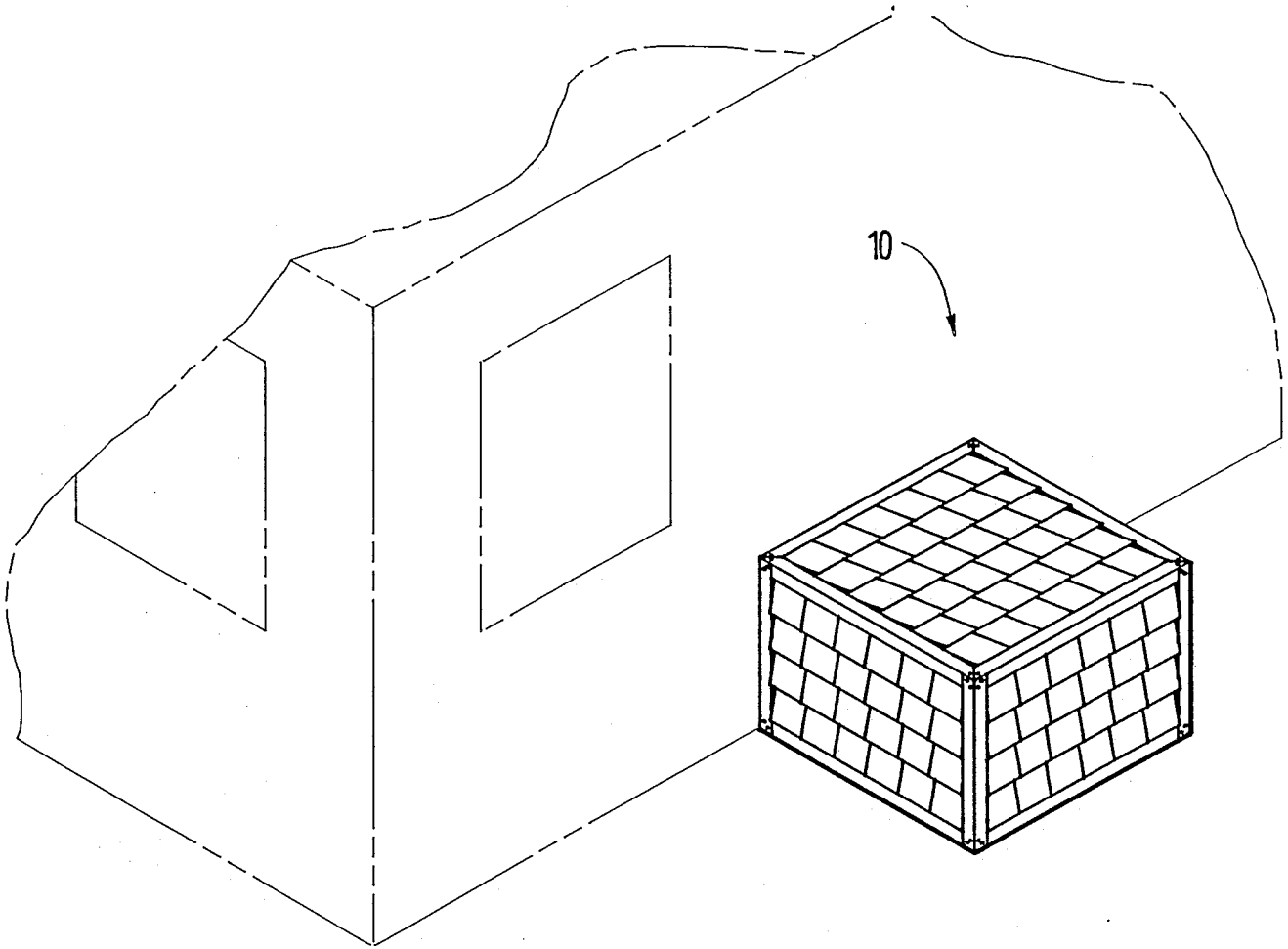
FIG. 7 is a perspective view of the cover installed adjacent a exterior building wall.

FIG. 7 is a perspective view of the cover 10 in an installed condition over an air compressor/condenser unit, with the open side of the cover in abutment with an exterior sidewall of a house, a mobile home, or other building.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioner compressor sectionalized cover, comprising:

a housing having four generally vertical corner posts;

each adjacent pair of said corner posts connected at a top end by a top rail and at a bottom end by a bottom rail, each pair of said top and bottom rails extending in generally horizontal parallel relation;

three generally vertical sidewalls and a horizontal ceiling of said housing formed by a plurality of rows of shutters, said housing having an open side;

each of said rows of shutters formed by a plurality of pairs of interconnected adjacent shutters;

each pair of adjacent shutters of each row joined by mating interlocking fasteners to allow said housing to be assembled in a variety of different dimensions for use with a variety of different sizes of external air compressor units;

means mounting each of said rows of shutters for movement between open and closed positions;

means for retaining each of said rows of shutters in said open position;

and an open bottom end of said housing dimensioned for insertion over an external air compressor unit.

2. The air conditioner compressor sectionalized cover of claim 1, further comprising a plurality of generally horizontal pivot rods extending in parallel spaced relation between said corner posts at each side of said housing and between two of said top rails at said housing ceiling;

and each of said shutters having a mounting boss portion mounted on one of said pivot rods and mounting said shutters for movement between open and closed positions.

3. An air conditioner compressor sectionalized cover, comprising:

a housing having four generally vertical corner posts;

each adjacent pair of said corner posts connected at a top end by a top rail and at a bottom end by a bottom rail, each pair of said top and bottom rails extending in generally horizontal parallel relation;

three generally vertical sidewalls and a horizontal ceiling of said housing formed by a plurality of rows of shutters, said housing having an open side;

means mounting each of said rows of shutters for movement between open and closed positions;

means for retaining each of said rows of shutters in said open position;

an open bottom end of said housing dimensioned for insertion over an external air compressor unit;

a plurality of generally horizontal pivot rods extending in parallel spaced relation between said corner posts at each side of said housing and between two of said top rails at said housing ceiling;

each of said shutters having a mounting boss portion mounted on one of said pivot rods and mounting said shutters for movement between open and closed positions;

an arcuate retaining bracket perpendicularly secured to an inner face of one of said shutters in each row, adjacent one of said corner posts of said four housing sidewalls or one of said two top rails of said housing ceiling;

cooperating apertures formed in said corner posts and said two top rails of said ceiling, and in end portions of said retaining bracket;

and retaining pins for insertion through said cooperating apertures to secure each row of shutters in said open position.

4. An air conditioner compressor sectionalized cover, comprising:

a housing having four generally vertical corner posts;

each adjacent pair of said corner posts connected at a top end by a top rail and at a bottom end by a bottom rail, each pair of said top and bottom rails extending in generally horizontal parallel relation;

three generally vertical sidewalls and a horizontal ceiling of said housing formed by a plurality of rows of shutters, said housing having an open side;

means mounting each of said rows of shutters for movement between open and closed positions;

an outwardly angled flange formed at a bottom free edge of each of said shutters;

means for retaining each of said rows of shutters in said open position;

and an open bottom end of said housing dimensioned for insertion over an external air compressor unit.

5. The air conditioner compressor sectionalized cover of claim 4, further comprising an inwardly extending rib on an inner face of each of said shutters, said rib dimensioned for frictional engagement with a top edge of an adjacent row of shutters to retain said shutters in a closed position.

* * * * *